US010634473B2

(12) United States Patent
Travis

(10) Patent No.: US 10,634,473 B2
(45) Date of Patent: Apr. 28, 2020

(54) INTERNALLY COUPLEABLE JOINT

(71) Applicant: Raytheon Company, Waltham, MA (US)

(72) Inventor: Robert D. Travis, Waltham, MA (US)

(73) Assignee: Raytheon Company, Waltham, MA (US)

( * ) Notice: Subject to any disclaimer, the term of this patent is extended or adjusted under 35 U.S.C. 154(b) by 635 days.

(21) Appl. No.: 14/167,859

(22) Filed: Jan. 29, 2014

(65) Prior Publication Data

US 2015/0211832 A1 Jul. 30, 2015

(51) Int. Cl.
*F42B 15/36* (2006.01)

(52) U.S. Cl.
CPC ..... *F42B 15/36* (2013.01); *Y10T 403/55* (2015.01)

(58) Field of Classification Search
CPC ..... F42B 15/36; F42B 15/38; Y10T 403/55; Y10T 403/553; Y10T 403/556; Y10T 403/557; Y10T 403/5741; Y10T 403/5761; Y10T 403/5786; E04H 12/085; B64C 1/28; B64C 1/30; B64C 1/068; B64C 1/069; B64C 2211/00; B64D 2011/0046; E21B 17/046; E21B 17/042; E21B 43/105; B64G 1/641; B64G 1/645
USPC ..... 52/848, 849; 138/155, 109; 285/370, 285/404, 333, 334; 244/3.1–3.3; 102/377, 378
See application file for complete search history.

(56) References Cited

U.S. PATENT DOCUMENTS 1,394,459 A * 10/1921 Willard ..... B64C 1/068 138/144
1,547,759 A * 7/1925 Journeay ..... E21B 17/046 279/100
2,195,492 A * 4/1940 McDonald ..... F16L 37/252 285/330
2,239,026 A * 4/1941 Wagner ..... H01R 4/5025 174/91
2,296,198 A * 9/1942 Boynton ..... E21B 17/046 285/111
3,120,402 A * 2/1964 Wallen ..... F16L 37/101 220/315
3,122,383 A * 2/1964 Hirsch ..... F16L 37/1235 285/397
3,140,967 A * 7/1964 Kaufmann et al. ... F16B 39/225 156/273.9
3,173,714 A * 3/1965 Whitwell ..... H05B 7/14 285/114

(Continued)

FOREIGN PATENT DOCUMENTS

KR 1020120076747 * 7/2012 ..... G01D 21/00

*Primary Examiner* — Kyle J. Walraed-Sullivan

(57) ABSTRACT

An internally coupleable joint is disclosed. The joint can include a first component and a second component configured to mate with one another in an end-to-end relationship. An axially extending protrusion of the first component can interface with a corresponding recess of the second component. In addition, the first component and the second component can each have an internal coupling feature extending at least partially about an inner circumference of the respective component. The joint can also include a securing member having external coupling features configured to engage the internal coupling features of the first and second components to prevent separation of the first and second components.

14 Claims, 7 Drawing Sheets

(56) References Cited

U.S. PATENT DOCUMENTS 3,883,258 A * 5/1975 Hewson ..... F16B 12/24 403/292
3,969,859 A * 7/1976 Hisey ..... E04B 2/702 52/233
4,097,165 A * 6/1978 Quayle ..... E02D 5/523 403/11
4,277,125 A * 7/1981 Ball ..... H01R 13/622 439/311
4,485,740 A * 12/1984 Boss ..... F16B 21/10 102/293
4,512,596 A * 4/1985 Obrecht ..... E21B 17/043 285/330
RE31,995 E * 10/1985 Ball ..... H01R 13/622 439/313
4,564,225 A * 1/1986 Taylor ..... E21B 17/042 285/333
4,706,367 A * 11/1987 Garringer ..... E04F 11/1817 29/453
4,735,235 A * 4/1988 Anderson ..... F16L 59/16 138/109
4,735,444 A * 4/1988 Skipper ..... F16L 15/008 285/288.1
4,792,320 A * 12/1988 Nickel ..... F16C 3/026 464/181
4,821,818 A * 4/1989 Mefferd ..... E21B 17/046 175/323
4,878,285 A * 11/1989 Carstensen ..... E21B 17/042 29/451
5,018,771 A * 5/1991 Watts ..... E21B 17/042 285/333
5,028,117 A * 7/1991 Muhlenkamp-Becker ..... G02B 23/2476 385/117
5,086,854 A * 2/1992 Roussy ..... E21B 7/24 175/320
5,149,149 A * 9/1992 Wu ..... F16B 7/0413 285/396
5,243,874 A * 9/1993 Wolfe ..... B29C 45/14754 280/775
5,269,572 A * 12/1993 Mefferd ..... E21B 17/046 285/330
5,349,988 A * 9/1994 Walsh ..... F16L 33/18 138/109
5,394,803 A * 3/1995 Mort ..... F42B 15/36 102/377
5,454,661 A * 10/1995 Litvin ..... F16B 7/0413 403/292
5,713,608 A * 2/1998 Yang ..... F16L 37/088 285/149.1
5,749,788 A * 5/1998 Bourque ..... A63D 15/08 403/292
5,772,551 A * 6/1998 Mabie ..... F16G 3/00 24/33 P
5,857,713 A * 1/1999 Horimoto ..... F16L 37/252 285/114
6,069,320 A * 5/2000 Rocci ..... H01R 4/70 174/84 R
6,073,642 A * 6/2000 Huang ..... A45B 9/00 135/114
6,098,928 A * 8/2000 Bross ..... F42B 15/36 244/120
6,113,410 A * 9/2000 Heit ..... H01R 9/0503 411/304
6,279,877 B1 * 8/2001 Davis ..... H02G 1/083 254/134.3 FT
6,332,657 B1 * 12/2001 Fischer ..... A47B 47/0008 312/111
6,352,385 B1 * 3/2002 Wojciechowski ..... F16D 1/033 403/364
6,648,071 B2 * 11/2003 Hackworth ..... E21B 17/00 166/117
6,692,207 B1 * 2/2004 Bailey ..... F16B 37/122 411/180
6,726,395 B2 * 4/2004 Yu ..... F16B 7/182 403/296
6,739,630 B2 * 5/2004 Riedy ..... F16L 37/148 285/305
6,752,085 B2 * 6/2004 Roach ..... F42B 39/20 102/481
6,789,822 B1 * 9/2004 Metcalfe ..... B21D 39/04 166/206
6,840,702 B2 * 1/2005 Ko ..... F16B 12/36 403/292
7,004,669 B1 2/2006 Vaughn et al.
7,493,960 B2 * 2/2009 Leising ..... E21B 17/04 166/242.6
7,530,607 B2 * 5/2009 Luft ..... F16B 7/0406 285/402
7,559,583 B2 * 7/2009 Stoetzer ..... F16L 37/142 285/330
7,648,178 B1 * 1/2010 Andros ..... F16L 33/223 285/247
7,681,837 B2 * 3/2010 Nakamura ..... B64C 1/1415 244/119
7,887,098 B2 * 2/2011 Aas ..... E21B 17/043 285/391
8,029,315 B2 * 10/2011 Purdy ..... H01R 9/0521 439/578
8,209,913 B2 * 7/2012 Murata ..... E04H 12/08 52/40
8,225,877 B2 * 7/2012 Whiddon ..... E21B 17/06 166/207
8,348,542 B2 * 1/2013 Church ..... E21B 17/04 403/296
8,689,516 B2 * 4/2014 Richardson ..... B62D 27/023 52/655.1
8,739,861 B2 * 6/2014 Hughes ..... F16D 1/04 166/378
8,894,011 B1 * 11/2014 Guerquin ..... B64C 1/068 244/119
9,116,025 B2 * 8/2015 Seo ..... G01D 21/00
2003/0071514 A1 * 4/2003 Chen ..... B60B 3/145 301/35.623
2003/0085570 A1 * 5/2003 Ernst ..... E21B 17/042 285/333
2003/0184091 A1 * 10/2003 Ricard ..... F16L 37/113 285/358
2004/0156674 A1 * 8/2004 Ko ..... F16B 12/36 403/292
2005/0186821 A1 * 8/2005 Franks, Jr. ..... H01R 13/5205 439/271
2006/0125234 A1 * 6/2006 Ernst ..... E21B 17/042 285/333
2007/0175167 A1 * 8/2007 Allen ..... E04C 5/165 403/307
2007/0281523 A1 * 12/2007 Riley ..... B62D 23/005 439/157
2008/0193209 A1 * 8/2008 Henderson ..... F16B 5/0275 403/297
2009/0087255 A1 * 4/2009 Jorna ..... F16B 7/0453 403/171
2009/0130887 A1 * 5/2009 Guilbert ..... H01R 13/6277 439/321
2010/0008715 A1 * 1/2010 Minowa ..... E04L 31/585 403/203
2011/0180273 A1 * 7/2011 Hughes ..... E21B 17/04 166/380
2012/0201597 A1 * 8/2012 Comerford ..... E04C 5/165 403/306
2013/0292514 A1 * 11/2013 Moselage, III ..... B64C 1/069 244/120
2014/0013873 A1 * 1/2014 Seo ..... G01D 21/00 73/866.5
2014/0049036 A1 * 2/2014 Miller ..... F16L 25/021 285/48
2014/0064834 A1 * 3/2014 Jeggle ..... F16D 1/04 403/293

(56) References Cited

U.S. PATENT DOCUMENTS

| | | | | |
|---|---|---|---|---|
| 2014/0367118 | A1* | 12/2014 | Connor | E21B 43/103 166/380 |
| 2015/0080136 | A1* | 3/2015 | Kenno | E21B 17/07 464/88 |
| 2015/0260210 | A1* | 9/2015 | Murphy | F16B 7/025 403/297 |
| 2015/0361679 | A1* | 12/2015 | Kent | E04G 3/20 52/40 |

* cited by examiner

INTERNALLY COUPLEABLE JOINT

BACKGROUND

Several types of missile section-to-section joints are currently in regular use for missile construction, of which radial screw joints are the most common, followed by Marman flange/band arrangements. Radial screw joints include overlapping diameters of adjacent missile sections that are typically joined along their perimeters by a ring pattern of floating nutplates and flush head screws. Marman joint arrangements, on the other hand, have an external band that is tightened around flanges of adjacent missile sections.

BRIEF DESCRIPTION OF THE DRAWINGS

Features and advantages of the invention will be apparent from the detailed description which follows, taken in conjunction with the accompanying drawings, which together illustrate, by way of example, features of the invention.

Figure 1A:
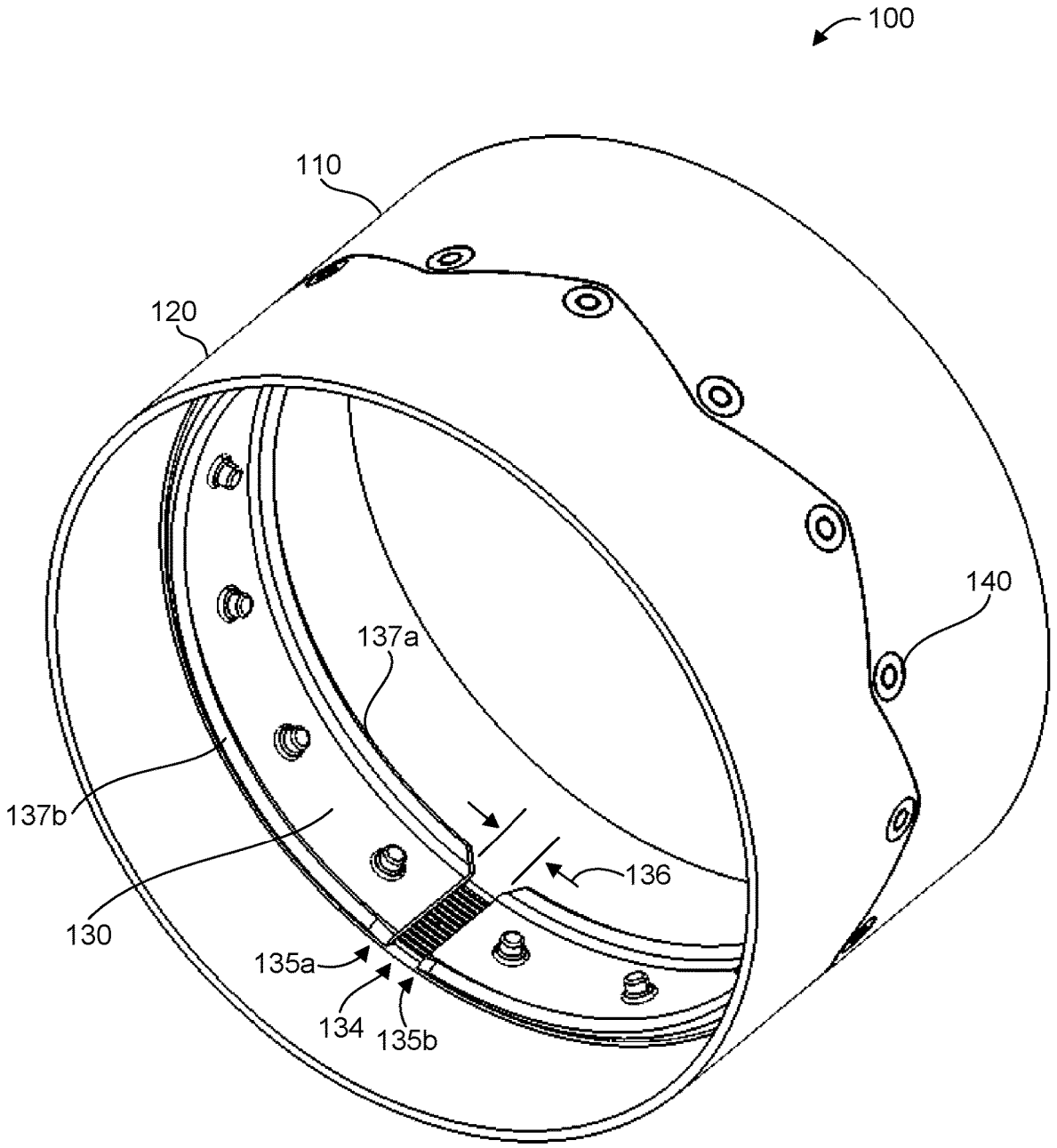
FIG. 1A is a perspective view of an internally coupleable joint in accordance with an embodiment of the present disclosure.

Reference will now be made to the exemplary embodiments illustrated, and specific language will be used herein to describe the same. It will nevertheless be understood that no limitation of the scope of the invention is thereby intended.

DETAILED DESCRIPTION

As used herein, the term "substantially" refers to the complete or nearly complete extent or degree of an action, characteristic, property, state, structure, item, or result. For example, an object that is "substantially" enclosed would mean that the object is either completely enclosed or nearly completely enclosed. The exact allowable degree of deviation from absolute completeness may in some cases depend on the specific context. However, generally speaking the nearness of completion will be so as to have the same overall result as if absolute and total completion were obtained. The use of "substantially" is equally applicable when used in a negative connotation to refer to the complete or near complete lack of an action, characteristic, property, state, structure, item, or result.

As used herein, "adjacent" refers to the proximity of two structures or elements. Particularly, elements that are identified as being "adjacent" may be either abutting or connected. Such elements may also be near or close to each other without necessarily contacting each other. The exact degree of proximity may in some cases depend on the specific context.

An initial overview of technology embodiments is provided below and then specific technology embodiments are described in further detail later. This initial summary is intended to aid readers in understanding the technology more quickly but is not intended to identify key features or essential features of the technology nor is it intended to limit the scope of the claimed subject matter.

Although radial screw joints and Marman flange/band arrangements have been serviceable in missile construction, these joints can have drawbacks when joining missile sections. For example, due to the overlapping portions and nutplates, radial screw joints can encroach significantly on internal adjacent volume. These joints also typically require tight production control with respect to fastener torqueing sequence and torque values. In addition, radial screw joints tend to move during shock events, and because the joints rely on screw clamp force and friction are geometrically indeterminate and not "positive" engagements from a missile straightness/alignment perspective. Marman joint arrangements, while generally occupying less internal volume than radial screw joints, protrude beyond the basic missile outer diameter, which can adversely impact aerodynamics, as well as require additional features for angular alignment of the adjacent missile sections. There is always a need to increase packaging volume on missile designs, especially in the joint areas where integration issues with harnessing, etc. are difficult due to limited space. It is also desirable for joint hardware to have a minimal impact on missile aerodynamics.

Accordingly, an internally coupleable joint is disclosed that provides increased interior space over prior designs without interfering with missile aerodynamics. In one aspect, the joint provides a "positive" joint with respect to alignment and movement during shock. The joint can include a first component and a second component configured to mate with one another in an end-to-end relationship. An axially extending protrusion of the first component can interface with a corresponding recess of the second component. In addition, the first component and the second component can each have an internal coupling feature extending at least partially about an inner circumference of the respective component. The joint can also include a securing member having external coupling features configured to engage the internal coupling features of the first and second components to prevent separation of the first and second components.

In one aspect, a securing member for an internally coupleable joint is disclosed. The securing member can include external coupling features configured to engage internal coupling features of a first component and a second component mated with one another in an end-to-end relationship to prevent separation of the first and second components from one another.

Figure 1B:
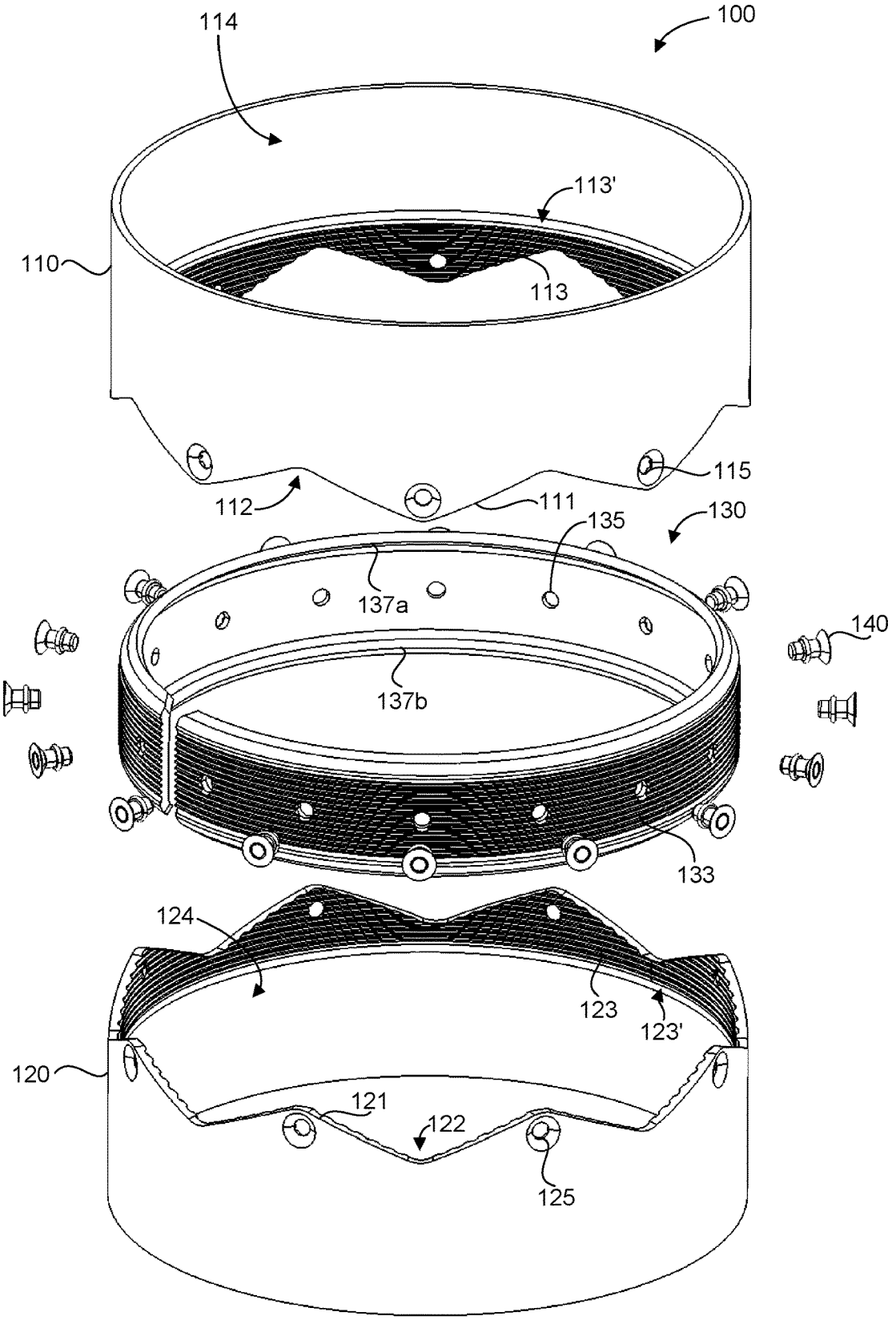
FIG. 1B is an exploded view of the internally coupleable joint of FIG. 1A.

One example of an internally coupleable joint 100 is illustrated in FIGS. 1A and 1B. The internally coupleable joint 100 can comprise a first component 110 and a second component 120, such as two missile sections. For example, the two components 110, 120 can be configured to contain components or equipment that may be housed within a missile, such as guidance electronics or a battery, and/or support an aerodynamic surface, such as a fin, on exterior surfaces of the components. Although the two components 110, 120 have been referenced in one example as being missile sections and illustrated as comprising a cylindrical configuration, it should be recognized that the two components 110, 120 can be any suitable components to be joined and can be of any shape or configuration.

As shown in the figures, the two components 110, 120 can be configured to mate with one another in an end-to-end relationship. For example, an axially extending protrusion 111 of the first component can interface with a corresponding recess 122 of the second component 120. In one aspect, each of the first and second components 110, 120 can comprise a plurality of axially extending protrusions 111, 121 and recesses 112, 122 configured to mate with one another in the end-to-end relationship. In other words, the protrusions 111, 121 at the ends of the two components 110, 120 can interlock in an interdigitated manner by butting against the recesses 112, 122. This butt joint configuration can occupy less space than a typical radial screw joint configuration where one component has a "necked down" smaller diameter portion that is nested within a larger diameter portion of another mating component. In one aspect, the mating engagement of the protrusions 111, 121 with the recesses 112, 122 can provide alignment of the two components at assembly and facilitate a proportional distribution of joint loads, as described hereinafter.

Figure 2:
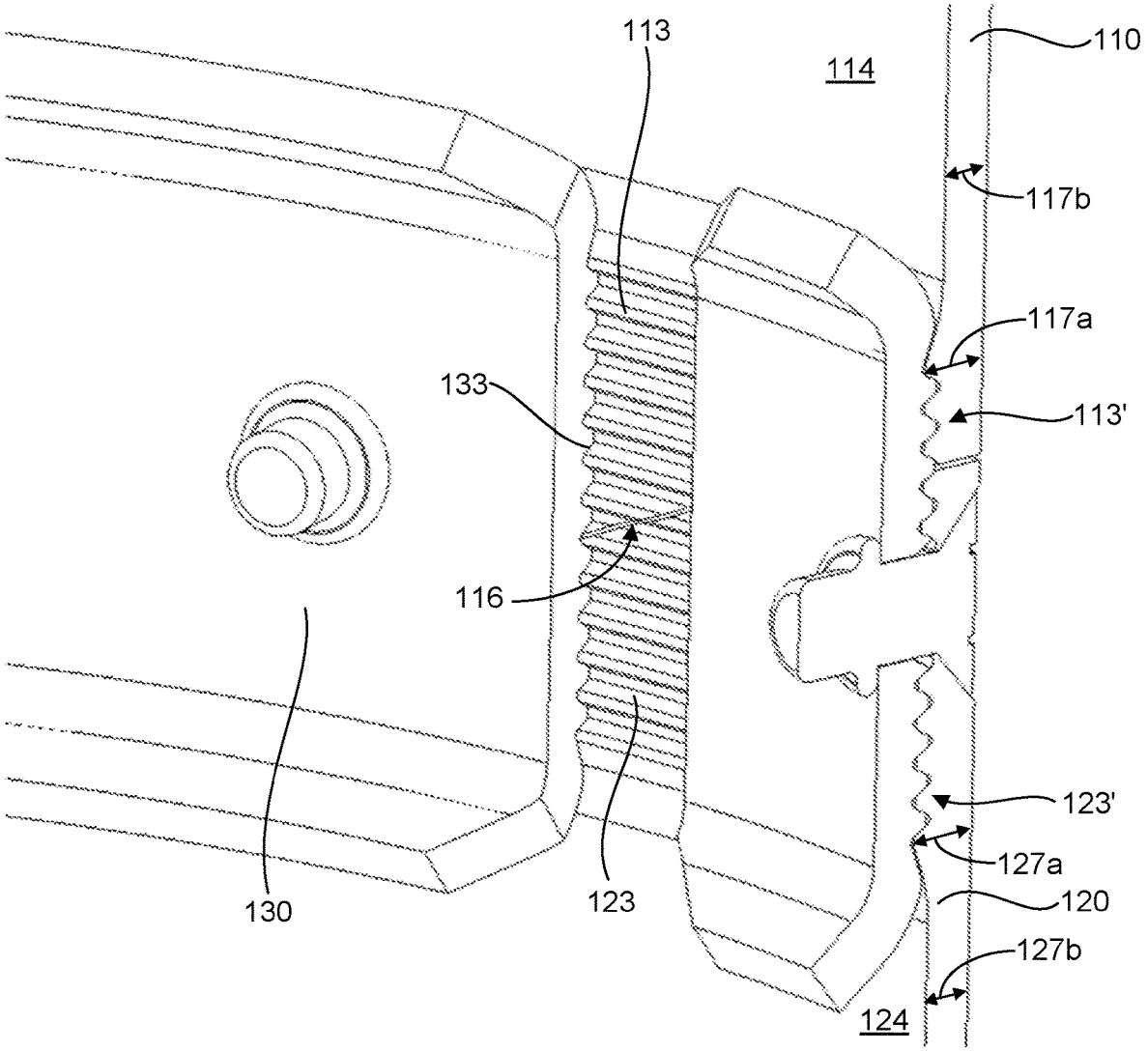
FIG. 2 is a detail cross-sectional view of the internally coupleable joint of FIG. 1A.

With reference to the detail view of FIG. 2, and continued reference to FIGS. 1A and 1B, the first component 110 and the second component 120 can each have an internal coupling feature 113, 123 extending at least partially about an inner surface or circumference 114, 124 of the first and second component 110, 120, respectively. The internally coupleable joint 100 can also include a securing member 130 that can have external coupling features 133 configured to engage the internal coupling features 113, 123 of the first and second components 110, 120 to prevent separation of the first and second components 110, 120. For example, the internal coupling feature 113, 123 can comprise a ridge and/or a groove and the external coupling feature can comprise a groove and/or a ridge to mate with the internal coupling feature. It should be recognized that the joint configurations disclosed herein can provide a "positive" joint with respect to alignment and movement during shock. In some embodiments, the securing member 130 can be coupled to the first and second components 110, 120 with one or more fasteners 140, as discussed further hereinafter.

In one aspect, the internal coupling features 113, 123 of the mated first and second components 110, 120 can form an annular ridge and/or an annular groove that traverses an interface 116 of the first component and the second component 110, 120. Thus, a securing member 130 can be configured to only partially "cover" the interface 116 of the first and second components 110, 120. However, for greater strength in the joint, the internal coupling feature 113, 123 of the first and/or second components 110, 120 can form an annular ridge and/or an annular groove uninterrupted by the axial protrusion and the recess. For example, the first one to three ridges/grooves 113', 123' can extend completely and uninterrupted around the inner surface or circumference 114, 124 of the first and second components 110, 120. This can provide structural integrity for one to three ridges to engage mating coupling features of the securing member 130, which, like typical a threaded joint, can carry the majority of the joint load. Additionally, in the protrusions 111, 121, the load carrying internal coupling feature engagement can proportionally shift from the one component to the other component.

In some embodiments, a coupling feature thickness 117*a*, 127*a* and a component wall thickness 117*b*, 127*b* can be such that the material removed to achieve the component wall thickness 117*b*, 127*b* is minimized by only requiring enough material to maintain tensile strength area through the recesses. This can provide a cost savings over a typical radial screw joint configuration where one component has a smaller diameter portion that is nested within a larger diameter portion of another component. Such radial screw joints are typically constructed starting with a thick tube that is machined down to size or by riveting or welding a separate component to provide the smaller and/or larger diameter portions.

Figure 3A:
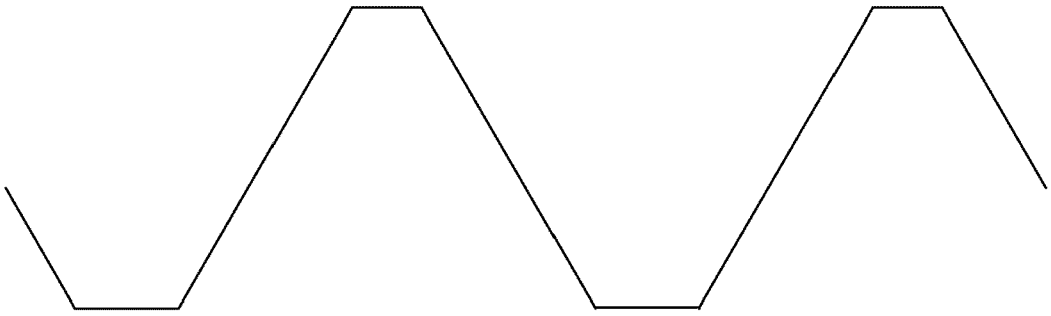
FIGS. 3A-3D are cross-sectional views of internal and/or external coupling features of an internally coupleable joint, in accordance with several embodiments of the present disclosure.
Figure 3B:
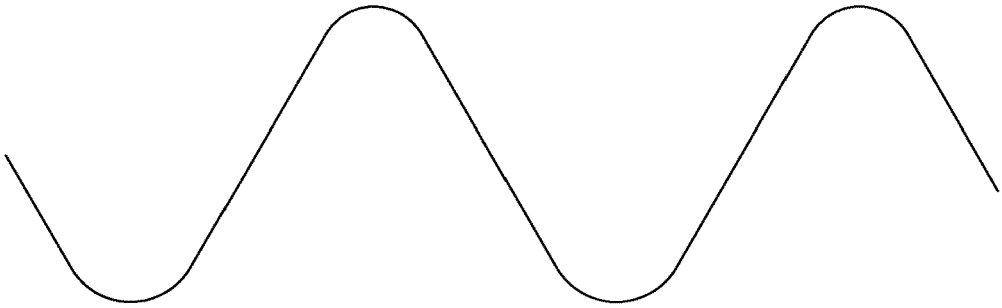
Figure 3C:
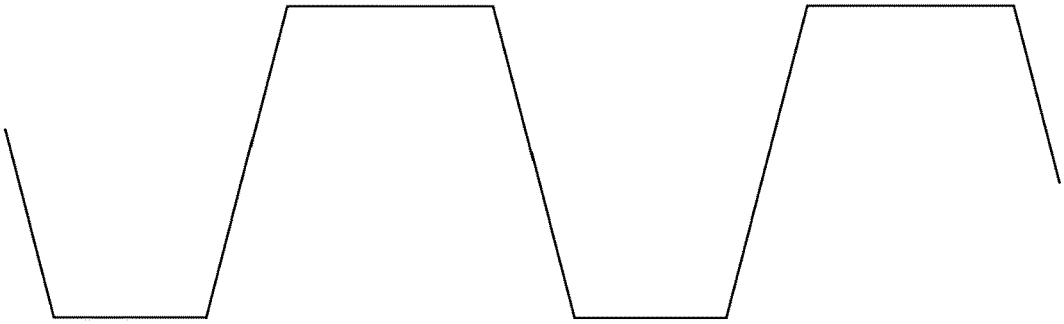
Figure 3D:
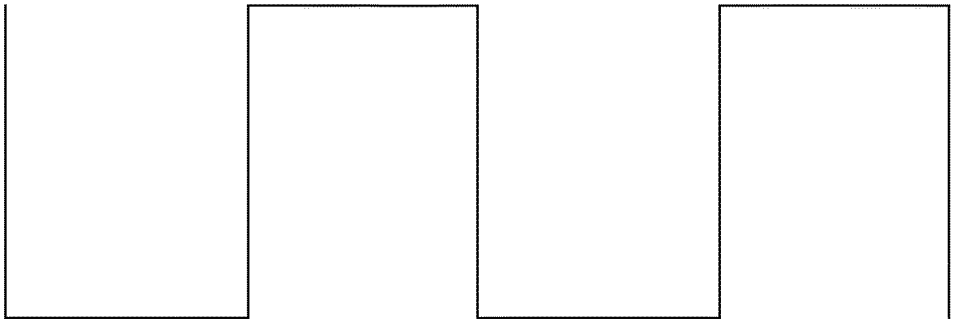

FIGS. 3A-3D illustrate cross-sections views of several generic examples of internal and/or external coupling features in accordance with the present disclosure. In particular, these examples illustrate cross-sections of several standard thread forms that may be applied to an internal and/or external coupling feature. It should be understood that, unlike a thread form of a typical fastener, the present coupling features are not helical, in that a given ridge or groove forms a complete, closed loop, and may not be "tightened" or "loosened" like a typical threaded fastener. Accordingly, the thread forms illustrated, when applied to the coupling features, merely illustrate cross-sectional shapes that may be utilized to facilitate the transfer of joint loads through a securing member coupled to two components that are in an end-to-end relationship, as described herein. For example, FIGS. 3A and 3B illustrate internal and external threads, respectively, in accordance with the Unified Screw Thread standard form. FIG. 3C illustrates an ACME screw thread form and FIG. 3D illustrates a square thread form. It should be recognized that any suitable cross-sectional thread form or fastener configuration may be utilized for mating internal and external coupling features, such as the thread forms disclosed in U.S. Pat. No. 5,090,852 or the "shoulders" and "grooves" disclosed in U.S. Pat. No. 3,915,053, each of which is incorporated herein by reference. Additionally, it should be recognized that a given ridge or groove need not reside in a single plane, but may have any suitable shape and/or trace out any suitable path in forming a complete, closed loop. For example, a path of a ridge or groove can mimic or resemble the form of the protrusions and/or recesses of two components configured to mate with one another in an end-to-end relationship. The internal and/or external coupling features can be formed in any suitable manner such as by machining, cutting, and/or rolling operations.

With further reference to FIGS. 1A and 1B, in one aspect, the securing member 130 can comprise a ring configuration having a separation 134 defining opposite ends 135*a*, 135*b* of the ring to facilitate varying a diameter of the ring to enable assembly of the securing member 130 with the first and second components 110, 120. The joint configuration illustrated can provide increased interior space in the joint area when compared to a radial screw joint. In one aspect, the securing member 130 can have an outer diameter that is less than an inner diameter of the internal coupling features to facilitate assembly. As shown in the figures, the securing member 130 can be configured to have a gap 136 between the opposite ends 135*a*, 135*b* of the ring when assembled, which can result from an enlargement of the outer diameter of the securing member 130 as it is installed and coupled with the first and second components 110, 120. In some embodiments, the securing member 130 can have a relatively thin cross-section, and can be roll formed from flat metal strip. Accordingly, in one aspect, the securing member 130 can comprise a flange 137*a*, 137*b*, configured to enhance a stiffness of the securing member 130 and resist radial flattening of the securing member 130 between fasteners 140. For example, edges of the securing member 130 can be bent to form the flange, although other configurations are possible. In one aspect, holes 135 in the securing member 130 configured to receive fasteners 140 can be punched while in a flat or straight configuration, prior to being rolled into the final shape.

Because the securing member 130 engages interior features of the two components 110, 120, exteriors of the two components 110, 120 can remain free of clamping apparatuses or other features, which can be beneficial for a missile or other applications where external clamp features or structures are not desired. In one aspect, the securing member 130 can facilitate coupling ends of the two components 110, 120 together to form a butt-type joint while the protrusions and recesses coaxially align the two components 110, 120. The securing member 130 can therefore be used when exteriors of the two components 110, 120 are not accessible for clamping and/or there is not enough space to use a typical clamp (such as an external V-band clamp, sometimes called a Marman clamp). It should be recognized that the securing member 130 can be configured for any suitable internal diameter, large or small, and is not to be limited to any particular internal diameter size disclosed or implied herein.

In one aspect, the internally coupleable joint 100 can include a plurality of fasteners 140 to couple the securing member 130 to the first and second components 110, 120. In a particular aspect, the first component 110, the second component 120, and/or the securing member 130 can include holes 115, 125, 135 to receive the fasteners 140. The fasteners can be configured to maintain the securing member 130 in engagement with the first and second components 110, 120. In one aspect, a fastener can comprise a bolt, a nut, a nutplate, a rivet, a blind bolt, blind rivet, a fastener with proportioned strength lock grooves, or any other suitable fastener. In one aspect, holes 135 in the securing member 130 can be threaded to receive a threaded fastener. In another aspect, temporary fasteners can be used during assembly. When using blind bolt fasteners, which do not require use of a nutplate, the blind side heads of the blind bolt occupy only a fraction of the space that a typical nut plate would occupy. Thus, according to the principles disclosed herein, a tight, positive, aero-flush missile joint with significantly increased adjacent useable cavity space within the missile sections can be provided. Such a joint can also be easy and quick to assemble.

Although fasteners are shown, it should be recognized that the securing member 130 can be supported about and/or coupled to the first and/or second components 110, 120 by any suitable structure, feature, or mechanism that can maintain the mechanical coupling of the securing member 130 with the first and second components 110, 120, such as an adhesive, an expandable internal bladder, or an expandable "umbrella" type structure, welding, for example, and others as will be recognized by those skilled in the art.

One aspect of the internally coupleable joint 100 disclosed herein is that the primary load path is through the securing member 130, not the fasteners, which are primarily in tension and serve to maintain the securing member 130 in radial contact with the first and second components 110, 120 and prevent slippage of the two components relative to one another. Since the primary duty of the fasteners is to inhibit disengagement of the securing member 130 from the first and second components 110, 120, rather than carry primary loads, the fasteners can be of a much smaller, lower strength variety, such as blind bolts or blind rivets, which can save weight and money.

For assembly of the internally coupleable joint 100, the securing member 130 can be installed into the first component 110, such as with a fastener at one end of the securing member 130 extending into a protrusion, which can fix the end of the securing member 130 both axially and radially relative to the first component 110. Following this, the second component 120 can be positioned against the first component 110. In one aspect, the first and second components can be self-aligned with one another due to the mating of the protrusions and recesses. A second fastener can then be used to couple the securing member 130 to the second component 120. In one aspect, the second fastener can be disposed in a protrusion that is adjacent to the protrusion coupled with the first fastener. Additional fasteners can be used to couple the securing member 130 to successive adjacent protrusions of the first and second components, thereby expanding the securing member 130 into contact with the first and second components 110, 120, until the opposite end of the securing member 130 is brought into radial contact with, and coupled to, the first or second component 110, 120. In one aspect, the fasteners 140 can be disposed in a ring pattern or configuration about the first and second component 110, 120 when coupled to the securing member 130.

Figure 4A:
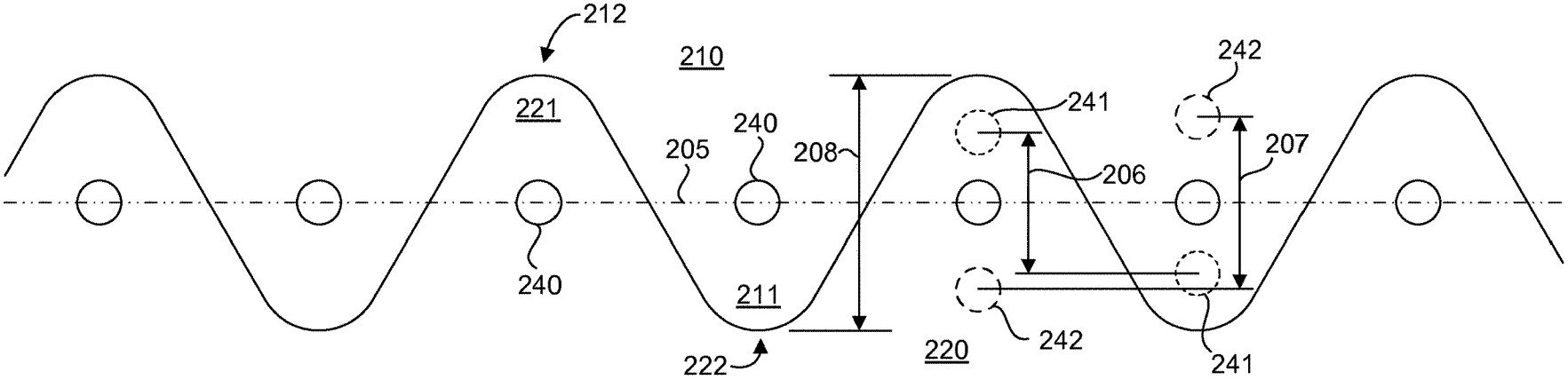
FIGS. 4A and 4B illustrate projected views of protrusions and recesses of an internally coupleable joint, in accordance with embodiments of the present disclosure.
Figure 4B:
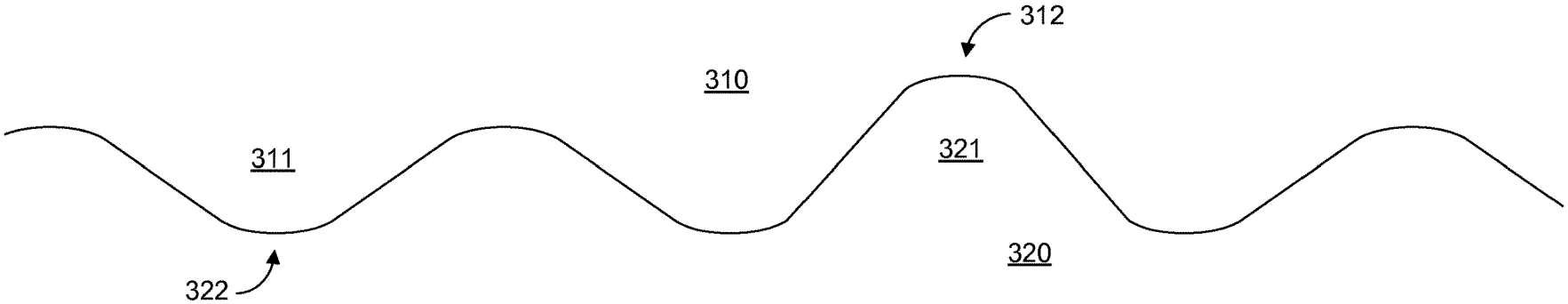

FIGS. 4A and 4B illustrate projected views of protrusions and recesses in accordance with examples of the present disclosure. For example, FIG. 4A shows protrusions 211, 221 and recesses 212, 222 of first and second components 210, 220, respectively. In this case, the protrusions and recesses are configured such that the ends of the first and second components are identical, which is unlike a radial screw joint configuration where one component has a smaller diameter portion that is nested within a larger diameter portion of another component. In one aspect, fasteners 240 extending through the protrusions 211, 221 can be located along a common line or plane 205 in a coplanar configuration, such as extending through a center of the protrusions 211, 221. In another aspect, fasteners 241, 242 can be offset 206, 207 toward or away from tips of the protrusions, respectively. It should be recognized that fasteners can be in any suitable location relative to the protrusions and/or arranged in any suitable pattern. It should also be recognized that the protrusions 211, 221 can be of any suitable length 208, where a longer length may contribute to greater joint strength.

FIG. 4B shows protrusions 311, 321 and recesses 312, 322 of first and second components 310, 320, respectively. In this case, the protrusion 321 and the mating recess 312 are configured different than the protrusion 311 and the mating recess 322. This can be useful to "key" the relative orientation of the first and second components 310, 320. It should be recognized that any suitable number of protrusions and recesses can be utilized and can be of any suitable shape, such as comprising a curve and/or a line. In one aspect, shapes or profiles of protrusions and recesses can be configured for low observable radar stealth.

Figure 5:
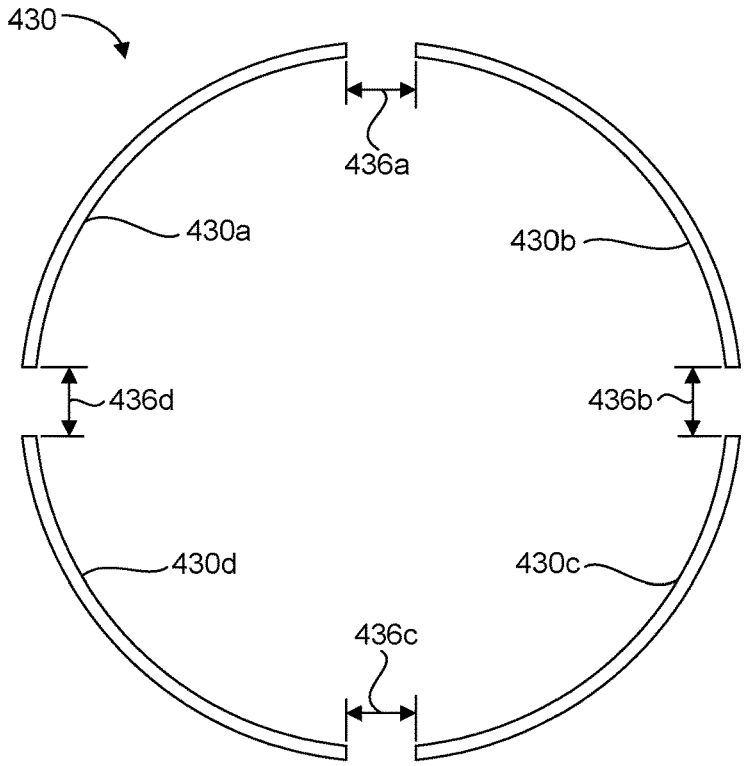
FIG. 5 is a schematic illustration of a securing member of an internally coupleable joint, in accordance with an embodiment of the present disclosure.

FIG. 5 illustrates a securing member 430 in accordance with an example of the present disclosure. In this example, the securing member 430 comprises a plurality of individual segments or components. As shown in the figure, the securing member 430 comprises four individual segments 430*a-d*, which can be assembled or installed separately. In this case, the segments 430*a-d* are configured to provide gaps 436*a-d* when assembled.

Figure 6:
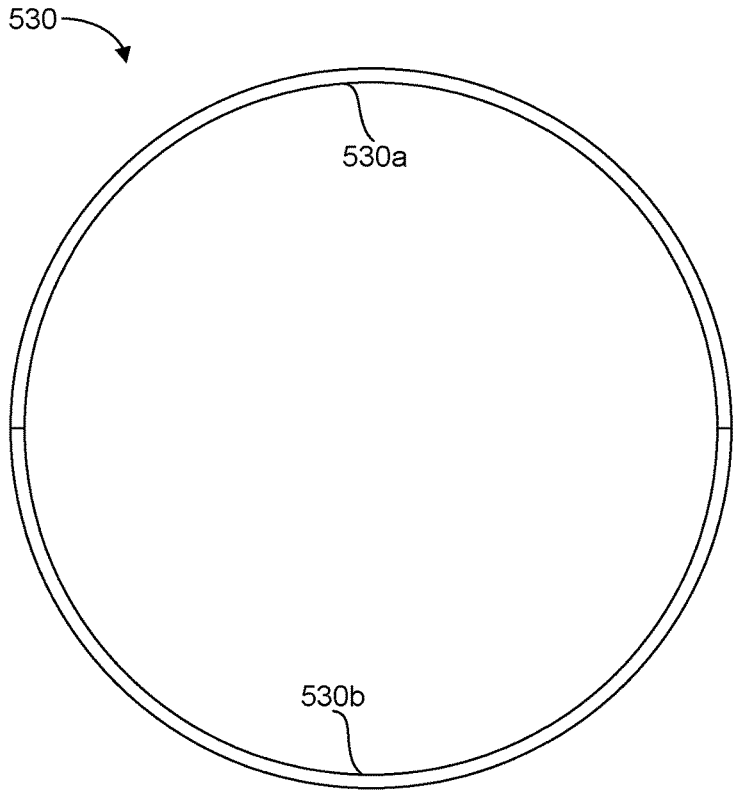
FIG. 6 is a schematic illustration of a securing member of an internally coupleable joint, in accordance with another embodiment of the present disclosure.

FIG. 6 illustrates a securing member 530 in accordance with another example of the present disclosure. Like the securing member 430 of FIG. 5, the securing member 530 comprises multiple individual segments or components 530*a*, 530*b*, which can be assembled or installed separately. In this case, however, the segments 530*a*, 530*b* are configured to position the opposite ends proximate one another in an end-to-end configuration when assembled, such that no gap is present between them when assembled.

Figure 7:
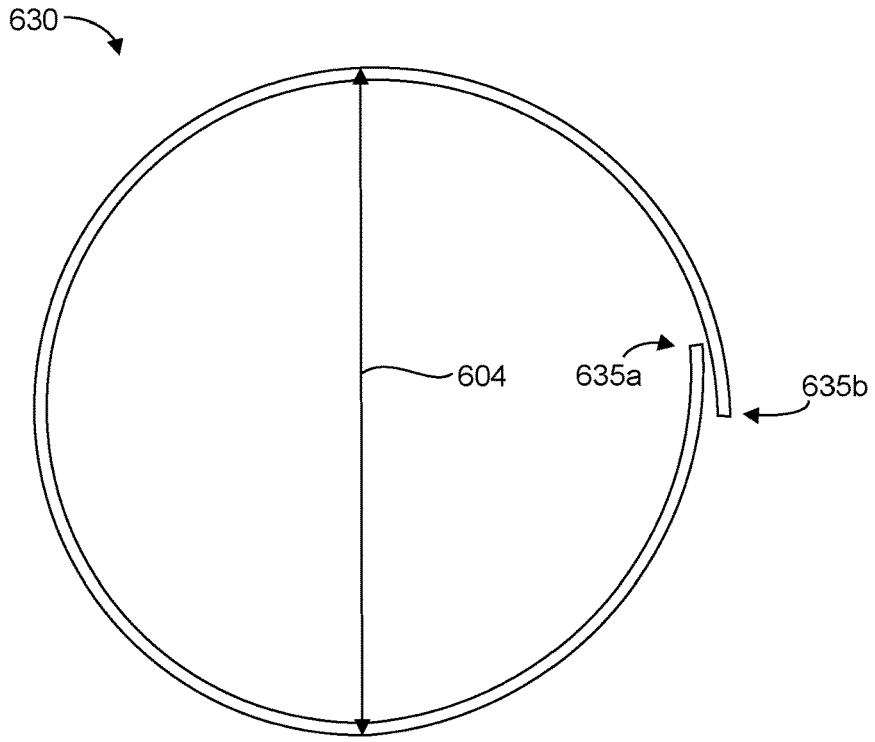
FIG. 7 is a schematic illustration of a securing member of an internally coupleable joint, in accordance with yet another embodiment of the present disclosure.

FIG. 7 illustrates a securing member 630 in accordance with yet another example of the present disclosure. The securing member 630 comprises only a single component. In this example, the securing member 630 is configured such that an end 635*a* can overlap an opposite end 635*b* to facilitate reducing a diameter 604 of the securing member 630, such as by some degree of "coiling," which can ease assembly. In addition, the securing member 630 can be configured such that the end 635*a* is positioned proximate the opposite end 635*b* in an end-to-end configuration when assembled, such that no gap is present between them when assembled. A configuration with no gaps can increase strength of the securing member 630 by making the securing member 630 compressively self-sustaining, such that even no fasteners were present, the securing member 630 would not collapse to a pre-installed shape.

Figure 8:
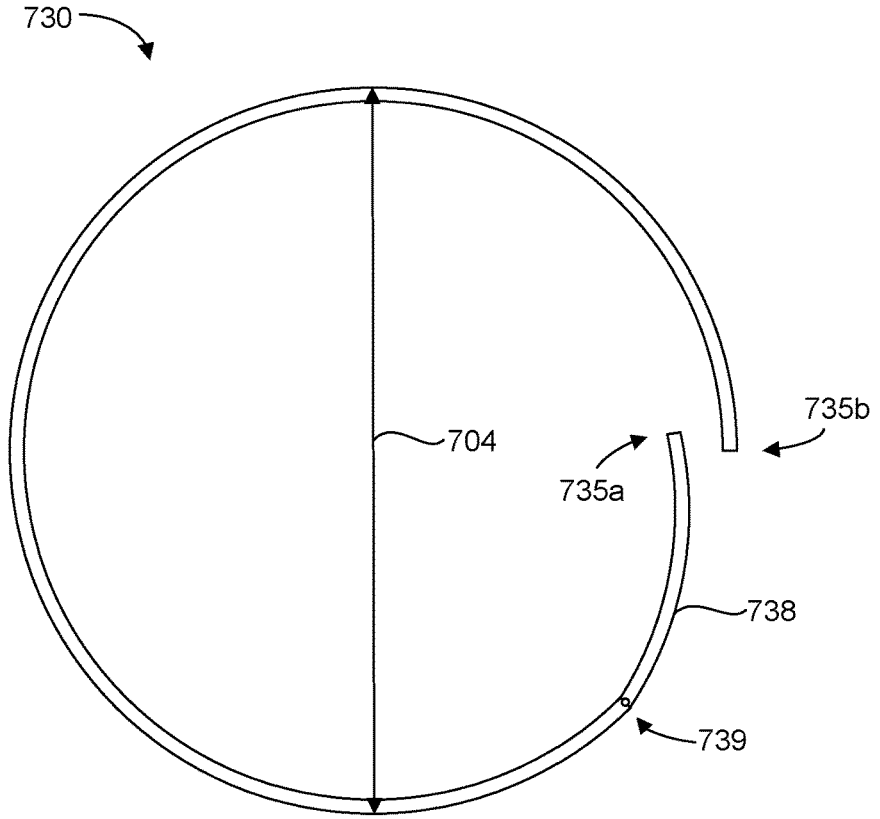
FIG. 8 is a schematic illustration of a securing member of an internally coupleable joint, in accordance with still another embodiment of the present disclosure.

FIG. 8 illustrates a securing member 730 in accordance with still another example of the present disclosure. Like the securing member 630 of FIG. 7, the securing member 730 is configured such that an end 735*a* can overlap an opposite end 735*b* to facilitate reducing a diameter 704 of the securing member 730, which can ease assembly. In addition, the securing member 730 is configured such that the end 735*a* can be positioned proximate the opposite end 735*b* in an end-to-end configuration when assembled, such that no gap is present between them when assembled. In this case, however, the securing member 730 comprises a rotatable portion 738 associated with the end 735*a* that can be rotated about a pivot 739. Thus, when installed, the rotatable portion 738 can be pulled into place, such as by a fastener, to position the end 735*a* adjacent the end 735*b*.

In accordance with one embodiment of the present invention, a method for facilitating internal coupling of two components is disclosed. The method can comprise providing a securing member for an internally coupleable joint of a first component and a second component mated with one another in an end-to-end relationship, wherein an axially extending protrusion of the first component interfaces with a corresponding recess of the second component, the first component and the second component each having an internal coupling feature extending at least partially about an inner circumference of the respective component. Additionally, the method can comprise facilitating engagement of external coupling features of the securing member with the internal coupling features of the first component and the second component to prevent separation of the first and second components from one another. In one aspect, the method can further comprise facilitating fastening the securing member to the first and second components. In another aspect, the securing member can comprise a flange configured to enhance a stiffness of the securing member. It is noted that no specific order is required in this method, though generally in one embodiment, these method steps can be carried out sequentially.

It is to be understood that the embodiments of the invention disclosed are not limited to the particular structures, process steps, or materials disclosed herein, but are extended to equivalents thereof as would be recognized by those ordinarily skilled in the relevant arts. It should also be understood that terminology employed herein is used for the purpose of describing particular embodiments only and is not intended to be limiting.

Reference throughout this specification to "one embodiment" or "an embodiment" means that a particular feature, structure, or characteristic described in connection with the embodiment is included in at least one embodiment of the present invention. Thus, appearances of the phrases "in one embodiment" or "in an embodiment" in various places throughout this specification are not necessarily all referring to the same embodiment.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary. In addition, various embodiments and example of the present invention may be referred to herein along with alternatives for the various components thereof. It is understood that such embodiments, examples, and alternatives are not to be construed as de facto equivalents of one another, but are to be considered as separate and autonomous representations of the present invention.

Furthermore, the described features, structures, or characteristics may be combined in any suitable manner in one or more embodiments. In the description, numerous specific details are provided, such as examples of lengths, widths, shapes, etc., to provide a thorough understanding of embodiments of the invention. One skilled in the relevant art will recognize, however, that the invention can be practiced without one or more of the specific details, or with other methods, components, materials, etc. In other instances, well-known structures, materials, or operations are not shown or described in detail to avoid obscuring aspects of the invention.

While the foregoing examples are illustrative of the principles of the present invention in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited, except as by the claims set forth below.

What is claimed is:

1. An internally coupleable joint, comprising:

a first component and a second component configured to be joined together in an end-to-end relationship, wherein an axially extending protrusion of the first component interfaces with a corresponding recess of the second component, the first component and the second component each having one or more non-helical internal coupling features extending at least partially about respective inner circumferences of the first and second components, respectively, wherein at least one of the one or more non-helical internal coupling features of the second component is interrupted by the recess, and operable to be aligned with at least one of the one or more non-helical internal coupling features of the first component, to traverse an interface of the first component and the second component, and wherein at least one of the one or more non-helical internal coupling features of the second component is continuous and uninterrupted by the recess; and an internal securing member comprising first and second ends defined by a separation between the first and second ends, the internal securing member having external coupling features configured to engage the one or more non-helical internal coupling features of the first and second components, wherein the first and second ends are configured to move radially outward to engage the external coupling features with the non-helical internal coupling features of the first and second components to prevent separation of the first and second components, and wherein, upon securing the internal securing member to the first and second components, the one or more non-helical internal coupling features of the first and second components are engaged with the external coupling features of the internal securing member, such that an uninterrupted separation gap is defined between the first and second components.

2. The internally coupleable joint of claim 1, further comprising a plurality of fasteners operable to couple the internal securing member to the first and second components.

3. The internally coupleable joint of claim 2, wherein the first component, the second component, and the internal securing member include holes to receive the plurality of fasteners.

4. The internally coupleable joint of claim 3, wherein the holes are formed in a coplanar pattern about the first and second components.

5. The internally coupleable joint of claim 1, wherein each of the first and second components comprise a plurality of axially extending protrusions and recesses configured to mate with one another in the end-to-end relationship.

6. The internally coupleable joint of claim 1, wherein the first component and the second component comprise a cylindrical configuration.

7. The internally coupleable joint of claim 1, wherein the one or more non-helical internal coupling features of at least one of the first or second components comprises at least one of a ridge or a groove and the external coupling features of the internal securing member comprise at least one of a groove or a ridge to mate with the one or more non-helical internal coupling features of at least one of the first or second components.

8. The internally coupleable joint of claim 1, wherein cross-sections of the one or more non-helical internal coupling feature of at least one of the first or second components and the external coupling features comprise mating cross-sectional thread form configurations.

9. The internally coupleable joint of claim 1, wherein the one or more non-helical internal coupling features of the first and second components form at least one of an annular ridge and an annular groove that traverses the interface of the first component and the second component when mated.

10. A method for facilitating internal coupling of two components, comprising:

providing an internal securing member for an internally coupleable joint of a first component and a second component joined together in an end-to-end relationship, wherein an axially extending protrusion of the first component interfaces with a corresponding recess of the second component, the first component and the second component each having one or more non-helical internal coupling features extending at least partially about respective inner circumference of the respective component, wherein at least one of the one or more non-helical internal coupling features of the second component is interrupted by the recess, and operable to be aligned with at least one of the one or more non-helical internal coupling features of the first component, to traverse an interface of the first component and the second component, and wherein at least one of the one or more non-helical internal coupling features of at least one of the first and second components is uninterrupted by the axial extending protrusion and the recess; and facilitating engagement of external coupling features of the internal securing member with the one or more non-helical internal coupling features of the first component and the second component to prevent separation of the first and second components from one another, wherein, upon securing the internal securing member to the first and second components, the one or more non-helical internal coupling features of the first and second components are engaged with the external coupling features of the internal securing member, such that an uninterrupted separation gap is defined between the first and second components.

11. The method of claim 10, further comprising facilitating fastening the internal securing member to the first and second components.

12. The method of claim 10, wherein the internal securing member comprises a flange configured to enhance a stiffness of the internal securing member.

13. An internally coupleable joint, comprising:

a first component and a second component configured to join together in an end-to-end relationship, the first component comprising a first axially extending protrusion configured to interface with a corresponding first recess of the second component, and at least one of the first component or the second component comprising a second axially extending protrusion that interfaces with a corresponding second recess of the other of the first or second components, the first and second axially extending protrusion and the first recess being configured differently than the second axially extending protrusion and second recess to facilitate keying of the relative orientation of the first and second components, the first component and the second component each comprising one or more non-helical internal coupling features extending at least partially about respective inner circumferences of the first and second components, respectively, wherein at least one of the one or more non-helical internal coupling features of the second component is operable to be aligned with at least one of the one or more non-helical internal coupling features of the first component, to traverse an interface of the first component and the second component; and an internal securing member comprising external coupling features configured to engage the one or more non-helical internal coupling features of the first and second components, wherein, upon securing the internal securing member to the first and second components, the one or more non-helical internal coupling features of the first and second components are engaged with the external coupling features of the internal securing member, such that an uninterrupted separation gap is defined between the first and second components.

14. An internally coupleable joint for a missile, the internally coupleable joint comprising:

a first missile section and a second missile section configured to be joined together in an end-to-end relationship, wherein an axially extending protrusion of the first missile section interfaces with a corresponding recess of the second missile section, the first missile section and the second missile section each having one or more non-helical internal coupling features extending at least partially about respective inner circumferences of the first and second missile sections, respectively, wherein at least one of the one or more non-helical internal coupling features of the second missile section is interrupted by the recess, and operable to be aligned with at least one of the one or more non-helical internal coupling features of the first missile section to traverse an interface of the first component and the second component, and wherein at least one of the one or more non-helical internal coupling features of the second missile section is continuous and uninterrupted by the recess; and an internal securing member comprising first and second ends defined by a separation between the first and second ends, the internal securing member having external coupling features configured to engage the one or more non-helical internal coupling features of the first and second missile sections, wherein the first and second ends are configured to move radially outward to engage the external coupling features with the non-helical internal coupling features of the first and second missile sections to prevent separation of the first and second missile sections, wherein, upon securing the internal securing member to the first and second missile sections, the one or more non-helical internal coupling features of the first and second missile sections are engaged with the external coupling features of the internal securing member, such that an uninterrupted separation gap is defined between the first and second missile sections.

* * * * *